US005097395A

United States Patent [19]

Aho et al.

[11] Patent Number: 5,097,395

[45] Date of Patent: Mar. 17, 1992

[54] MULTIPLE CAVITY LIGHT FIXTURE

[75] Inventors: Kenneth A. Aho, Chisago City; Richard A. Miller, Stillwater, both of Minn.

[73] Assignee: Minnesota Mining and Manufacturing Company, St. Paul, Minn.

[21] Appl. No.: 316,993

[22] Filed: Feb. 24, 1989

[51] Int. Cl.[5] ..... F21V 7/04

[52] U.S. Cl. ..... 362/32; 362/268; 362/331; 362/328; 362/308

[58] Field of Search ..... 362/61, 80, 268, 327, 362/328, 329, 331, 339, 299, 300, 307, 308, 310, 32, 31

[56] References Cited

U.S. PATENT DOCUMENTS

| | | | |
|---|---|---|---|
| 3,798,444 | 3/1974 | Brudy | 362/328 |
| 4,353,111 | 10/1982 | Gallitzendorfer et al. | 362/80 |
| 4,420,797 | 12/1983 | Tohata | 362/80 |
| 4,670,823 | 6/1987 | Kochi et al. | 362/268 |
| 4,680,680 | 7/1987 | Iwaki et al. | 362/268 |
| 4,740,870 | 4/1988 | Moore et al. | 362/32 |
| 4,823,246 | 4/1989 | Dilouya | 362/328 |
| 4,930,049 | 5/1990 | Davenport et al. | 362/32 |
| 4,933,813 | 6/1990 | Berger | 362/32 |

FOREIGN PATENT DOCUMENTS

| | | | |
|---|---|---|---|
| 207743 | 5/1957 | Australia | 362/331 |
| 712182 | 9/1931 | France | 362/61 |
| 1057744 | 3/1954 | France | 362/80 |
| 1055930 | 11/1967 | United Kingdom | 362/80 |

*Primary Examiner*—Ira S. Lazarus
*Assistant Examiner*—D. M. Cox
*Attorney, Agent, or Firm*—Gary L. Griswold; Walter N. Kirn; Stephen W. Buckingham

[57] ABSTRACT

A light fixture has an optical cavity having a first region and multiple additional regions, each of the additional regions, each of the additional regions having an optical window. Light from a light source in the first region is directed out of the optical windows in each of the additional regions.

8 Claims, 3 Drawing Sheets

MULTIPLE CAVITY LIGHT FIXTURE

BACKGROUND OF THE INVENTION

In many automotive lighting and display applications it is desirable to have a light fixture providing collimated, uniform intensity light emission over a large areal extent, in fixtures of minimal thickness. The thickness or depth of the light source is of particular importance in the field of automotive lighting because volume enclosed by the light fixture is lost to passenger or cargo space. The typical method of providing collimated beams of light is to utilize parabolic reflectors. Two disadvantages exist in the use of parabolic reflectors, however. One disadvantage relates to the size of the parabolic reflector. If the light source is to have a large aperture, the parabolic reflector must be relatively deep. This is incompatible with the goal of minimum thickness designs.

A second disadvantage lies in the existence of "hot" spots in the parabolic reflector's light emission pattern. The non-uniform emission results because the parabolic reflector is more efficient at gathering light near the center than at the edges.

Many light fixture designs have elongated light-emitting sections and may have a plurality of such regions. Such fixtures generally utilize multiple parabolic reflectors and light sources, requiring additional wiring and maintenance. Furthermore a parabolic reflector produces only a single collimated beam of light from a light source. Thus to illuminate multiple region, multiple light sources and reflectors are required even if the illuminated regions are small.

Reflective Fresnel structures that offer reductions in the depth requirements of parabolic reflectors are taught in U.S. Pat. No. 4,789,921, commonly assigned herewith. While reducing the volume enclosed by the light fixture, these devices do not provide a uniform intensity over the entire light-emitting surface.

Another approach to providing uniform intensity light emission over an extended area is taught in U.S. Pat. No. 4,799,137, commonly assigned herewith. The approach of that patent uses an optical cavity containing a substantially perpendicularly light reflecting film. A collimated light source provides light which is nearly parallel to the surface of the reflective film, resulting in reflected light emission substantially perpendicular to an optical window. That approach allows the fixture to be of shallow depth, while providing substantially uniform, collimated light emission over an extended area. It does not, however, adequately solve the problem of allowing a single light source to provide uniform intensity, collimated light emission from a light fixture with multiple elongated light-emitting regions which have a common junction.

SUMMARY OF THE INVENTION

In a light fixture according to the invention, an optical cavity has a first region and a plurality of additional regions, each of the additional regions having an optical window. The first region contains a light source and means for collimating light from the light source into a plurality of beams, one of said beams being directed into each of the additional regions. Each of the additional regions contains means for redirecting the beam out of the optical cavity through the associated optical window.

DETAILED DESCRIPTION OF THE PREFERRED EMBODIMENTS

Figure 1:
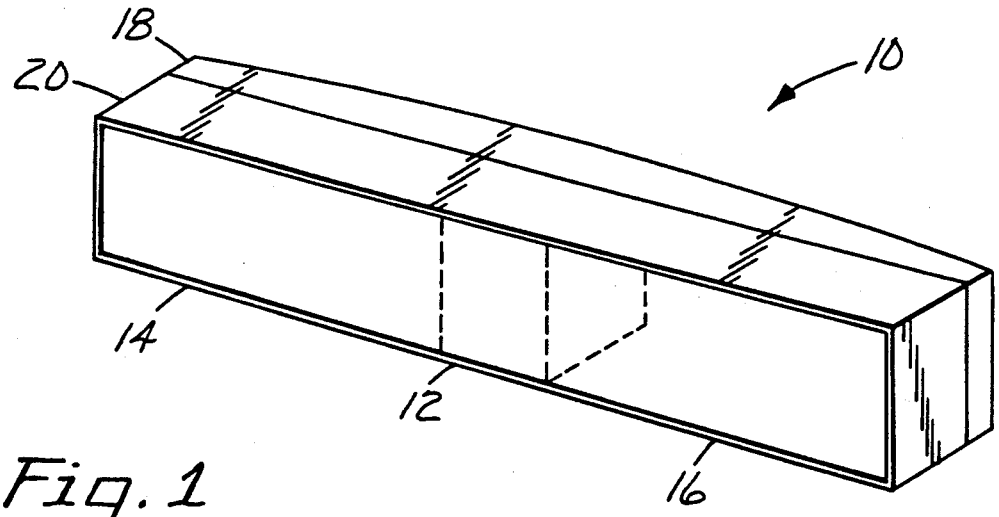
FIG. 1 is a perspective view of a light fixture according to the invention.

FIG. 1 shows the exterior of a light fixture 10 according to the invention. Light fixture 10 comprises a housing 18 defining an optical cavity. The optical cavity may be formed of a plurality of separate optical cavities in optical communication with each other. In the example of light fixture 10, three optical cavities 12, 14, and 16 are used. Alternatively those separate optical cavities may be considered separate regions of a single optical cavity. Each of the regions or cavities has an optical window and a light transmissive cover 20, that may comprise two or more abutting separate pieces, extending over the entire length of light fixture 10 in the optical windows. Typically the optical windows, and thus cover 20, are substantially planar. Cover 20 may be transparent or translucent and may include optical structures such as the pillow lenses used for light dispersion in automobile taillights. Furthermore, cover 20 could be colored. In the example of a taillight, it would typically be red or amber, or have sections of each color.

Figure 2:
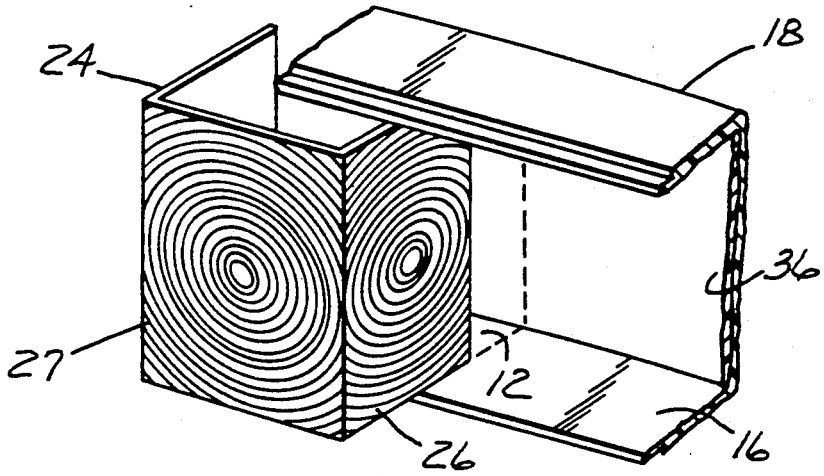
FIG. 2 is a perspective view of a region of a light fixture according to the invention.

FIG. 2 shows an expanded view of optical cavity 12, with cover 20 removed. Optical cavity 12 has two oppositely positioned collimating lenses 24 and 26 and a lens 27 positioned adjacent cover 20 and perpendicular to lenses 24 and 26. Lenses 24 and 26 transmit substantially collimated light beams from a light source cavity 12 into the adjacent optical cavities 14 and 16. Lens 27 collimates light from the light source and transmits it through the portion of cover 20 adjacent optical cavity 12. Lenses 24, 26, and 27 would typically be Fresnel lenses and preferably are catadioptric lenses of the type described in U.S. Pat. No. 4,755,921, commonly assigned herewith. A filter such as a partially reflecting mirror or neutral density film could be included to help provide even illumination over the surface of cover 20. In alternative designs where cavity 12 is not intended to emit light through cover 20, lens 27 may be omitted and the portion of cover 20 adjacent optical cavity 12 may be opaque.

Figure 3:
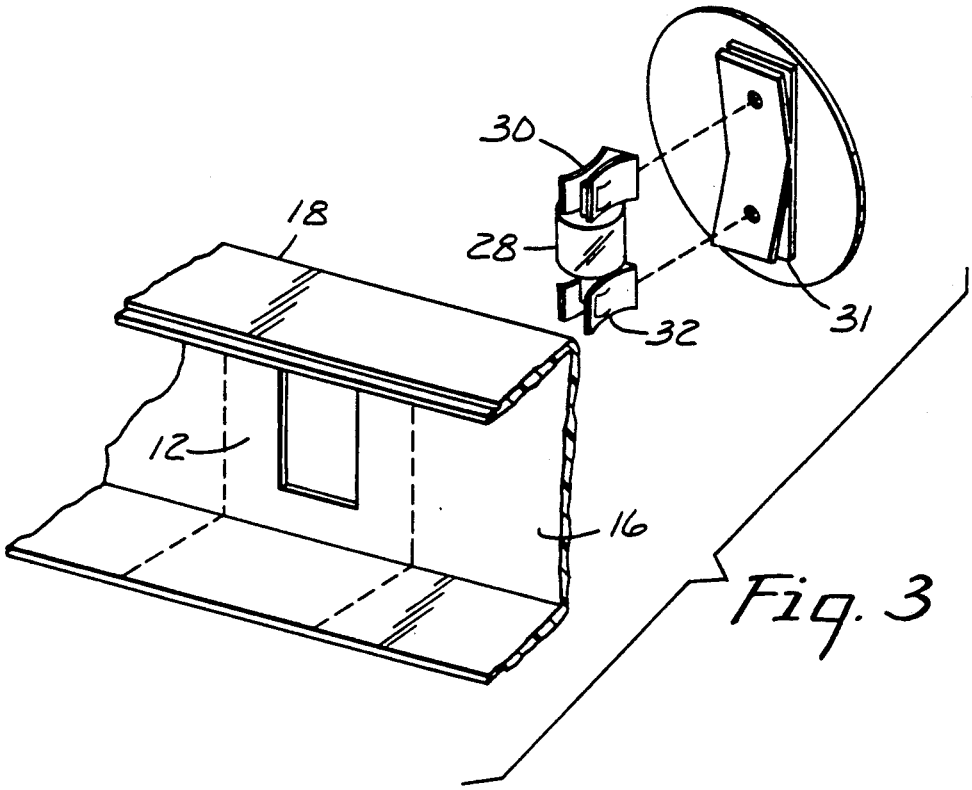
FIG. 3 is a cutaway view of the region of the light fixture shown in FIG. 2.

Optical cavity 12 contains a light bulb 28, that may be a linear filament bulb such as a Wagner Model 573. Light bulb 28 is supported by mounting clips 30 and 32 that are used to provide the electrical connections to the two ends of the bulb 28. Also shown in FIG. 3 is a metallic plate 31 that serves as a heat sink and reflector. Although light bulb 28 has a linear filament, the filament is short enough that the bulb approximates a point source, allowing use with a radial catadioptric lens. In other embodiments, a line source of light may be used and a linear catadioptric lens would be required.

Figure 4:
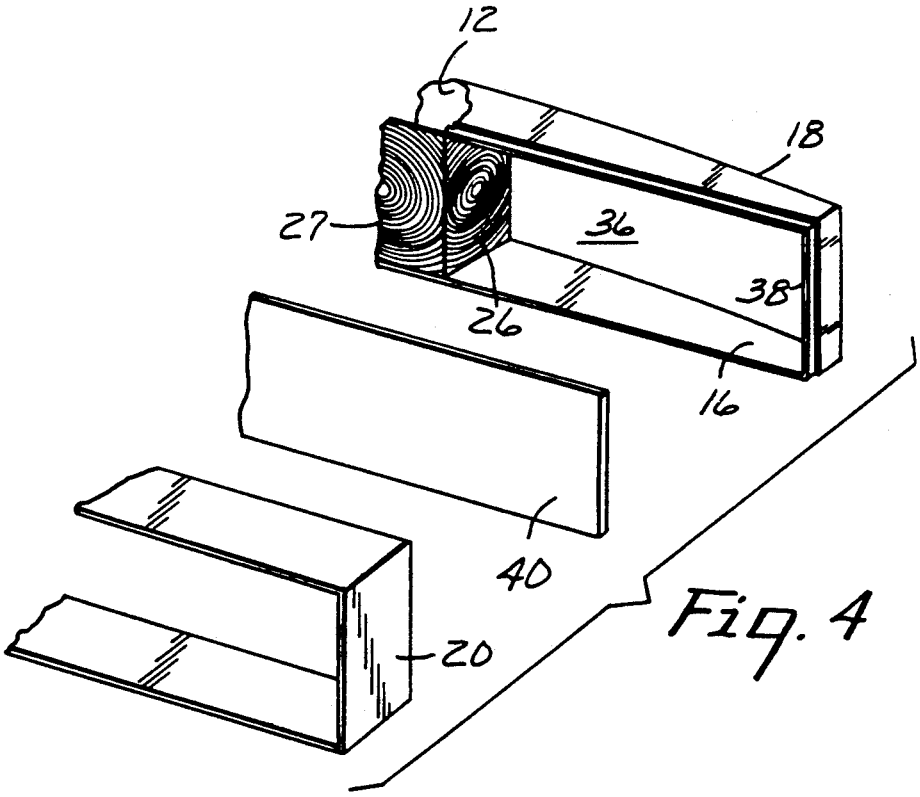
FIG. 4 is an exploded perspective view of another region of a light fixture according to the invention.

FIG. 4 is an exploded view of optical cavity 16. Optical cavity 16 has a rear surface 36, a mirror 38, a pillow lens 40, and cover 20. Surface 36 includes means for directing low angle light out of optical cavity 16 in a direction substantially perpendicular to the plane of light transmissive cover 20. The low angle light to be so redirected out of the optical cavity through the optical window is that of the light beam received from collimating lens 26. Surface 36 is preferably provided by attaching to the surface of housing 18, a film of the type described in U.S. Pat. No. 4,799,137, commonly assigned herewith and shown in more detail in FIG. 5.

Figure 5:
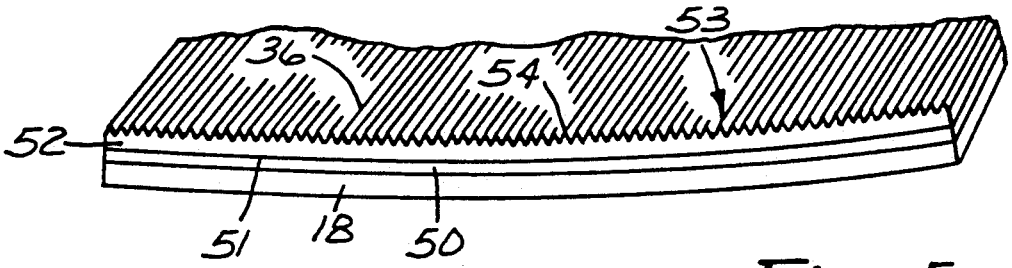
FIG. 5 is a schematic cross-sectional view of a surface of the region of FIG. 4.

As shown in FIG. 5, surface 36 includes housing 18, a specularly reflective material 50 adjacent a smooth surface 51 of a transparent material 52. Preferably reflective material 50 is provided by vapor coating aluminum on smooth surface 51. Transparent material 52 has a structured surface 53 on the side directed toward the interior of optical cavity 16. Structured surface 53 has a series of linear prisms such as prism 54, the cross section of each of the prisms preferably forming right equilateral triangles. Alternatively, surface 36 of FIG. 4 could be formed by providing a plurality of reflectorized prisms, appropriately shaped for directing light from light source 28 in a direction substantially perpendicular to cover 20. Mirror 38 preferably is an aluminum vapor-coated piece of smooth-surfaced film or structural plastic and is provided to reflect light back into optical cavity 16. Housing 18 may be formed by well-known techniques such as injection molding, using structural plastic materials such as polycarbonate or acrylics.

Figure 6:
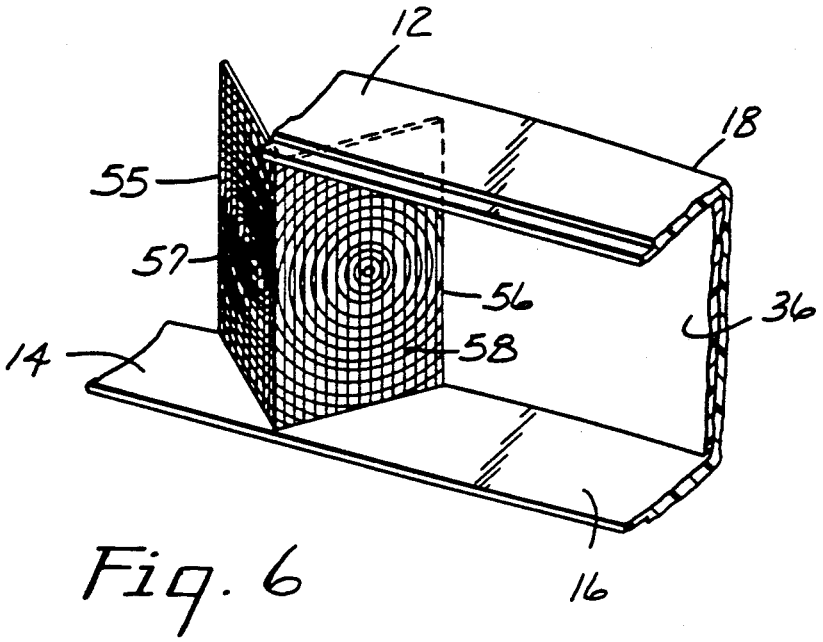
FIG. 6 is a cutaway view of an alternative embodiment of the region of FIG. 2.

FIG. 6 shows an alternative embodiment of optical cavity 12, that differs from that of FIG. 2 by using a combination of two sets of mutually-perpendicular structured-surface lenses, collimating lenses 55 and 56, and linear prism lenses 57 and 58, to collimate and deflect the light into optical cavities 14 and 16, respectively. In the preferred embodiment of this alternative design, both sets of lenses would be provided by combination lensfilms. Preferably the collimating lens structure is on the light bulb side of the film and a linear prism structure on the opposite side. The linear prism structure can be designed to deflect light only to optical cavities 14 and 16 or to split the transmitted light into two collimated beams. The split beam design would provide light for direct emission from optical cavity 12 as well as to optical cavities 14 and 16. This design offers improved appearance in the optical cavity 12 by separating the lens from the pillow lens.

Figure 7:
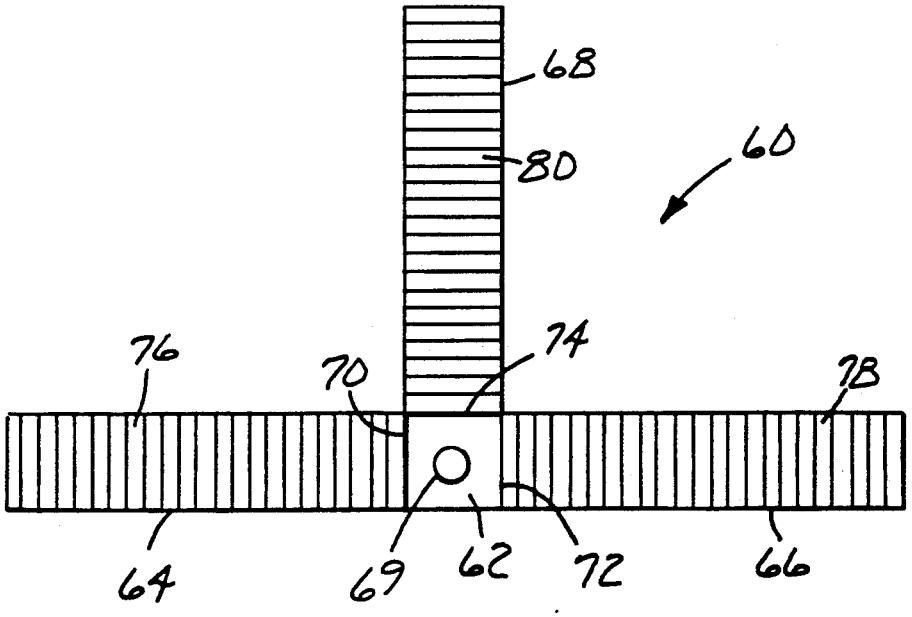
FIG. 7 is a schematic view of an alternative embodiment of a light fixture according to the invention.

FIG. 7 shows an alternative light fixture 60 according to the invention, having an optical cavity 62 with a light source 69 therein. Optical cavity 62 is optically connected to three additional optical cavities 64, 66, and 68. In this embodiment, shown with the cover and pillow lens removed, the collimating lenses shown schematically as 70, 72, and 74, direct light from light source cavity 62 onto perpendicular reflective surfaces 76, 78, and 80, respectively, in the same manner previously described for lens 26 and surface 36 of FIG. 4.

In another embodiment of the invention, a portion of the cover, such as cover 20 of FIG. 1, may be opaque in order to provide illuminated areas separated by dark regions. In order to insure that a maximum amount of light reaches the regions to be illuminated, those regions may be optically connected to the region containing the light source by a light pipe, such as the light pipe described in U.S. Pat. No. 4,805,984, commonly assigned herewith.

What is claimed is:

1. A light fixture comprising:

a housing defining an optical cavity having a plurality of optical windows each of said optical windows lying substantially in a plane; said optical cavity having a first region and a plurality of additional regions, each of said additional regions being associated with one of said optical windows;

a light source in said first region;

means for collimating light from said light source into a plurality of beams and directing one of said beams into each of said additional regions; and means in each of said additional regions for redirecting said light beams out of said optical cavity through said optical window associated therewith and each of said redirecting means redirecting said light in a direction substantially perpendicular to the plane of the optical window of its associated region.

2. The light fixture of claim 1 wherein said means for collimating light includes a plurality of catadioptric lenses.

3. The light fixture of claim 1 wherein said means for redirecting light includes a transparent film having a smooth surface and structured surface, said structured surface having a plurality of linear right angled prisms thereon, and a reflector adjacent said smooth surface.

4. The light fixture of claim 3 wherein said means for collimating light includes a plurality of catadioptric lenses.

5. The light fixture of claim 1 further comprising light transmissive covers in said optical windows.

6. The light fixture of claim 5 wherein said covers are transparent.

7. The light fixture of claim 5 wherein said covers are translucent.

8. The light fixture of claim 1 wherein said first region of said optical cavity has an optical window and said first region contains means for collimating light from said light source into a beam directed toward said first region optical window.

* * * * *